United States Patent [19]

Dickens et al.

[11] 4,376,921

[45] Mar. 15, 1983

[54] MICROWAVE COUPLER WITH HIGH ISOLATION AND HIGH DIRECTIVITY

[75] Inventors: Lawrence E. Dickens, Baltimore; Paul H. Mountcastle, Glen Burnie, both of Md.

[73] Assignee: Westinghouse Electric Corp., Pittsburgh, Pa.

[21] Appl. No.: 258,348

[22] Filed: Apr. 28, 1981

[51] Int. Cl.[3] ..... H01P 5/18

[52] U.S. Cl. ..... 333/116; 333/238

[58] Field of Search ..... 333/109, 115, 116

[56] References Cited

U.S. PATENT DOCUMENTS

| | | | |
|---|---|---|---|
| 2,770,779 | 11/1956 | Turner | 333/115 |
| 3,593,208 | 7/1971 | Smith | 333/116 X |
| 4,011,528 | 3/1977 | Podell et al. | 333/116 X |
| 4,027,254 | 5/1977 | Gunton et al. | 333/115 X |
| 4,216,446 | 8/1980 | Iwer | 333/116 X |

FOREIGN PATENT DOCUMENTS

| | | | |
|---|---|---|---|
| 2419613 | 11/1979 | France | 333/116 |

*Primary Examiner*—Paul L. Gensler
*Attorney, Agent, or Firm*—W. E. Zitelli

[57] ABSTRACT

A loosely coupled microstrip microwave coupler with high directivity is disclosed. The coupler comprises a ground plane substrate, a dielectric layer disposed over the substrate, and a section of each of the main and coupled transmission lines disposed on the exposed surface of the dielectric layer adjacently aligned with a predetermined gap therebetween to form a coupling region. The length of the coupling region is substantially less than ¼ wavelength of the operating microwave signal. A capacitive coupling element is disposed within the coupling region across the main and coupled transmission line sections for supplementing the dielectric capacitive coupling of the gap therebetween to increase the directivity of the microwave signal coupling. The capacitive coupling element splits the coupled transmission line section of the coupling region into two branches and is physically adjustable in size to balance the electric and magnetic field microwave coupling components of one of the branches to reduce the microwave power output thereof. As a result, the microwave power output of the other of the branches is representative of the microwave signal incident on the main transmission line section substantially.

6 Claims, 6 Drawing Figures

MICROWAVE COUPLER WITH HIGH ISOLATION AND HIGH DIRECTIVITY

GOVERNMENT CONTRACT

The United States has rights in this invention pursuant to Contract No. F-33657-79-C-0040 between the United States Air Force and Westinghouse Electric Corporation.

BACKGROUND OF THE INVENTION

The present invention relates broadly to microwave directional couplers, and more particularly, to a microstrip directional coupler with low coupling coefficients and high directivity.

Microwave couplers of the 20 dB type, for example, with the requirement of high directivity, are commonly used to sample and differentiate between the incident and reflected waves on a microwave transmission line. Couplers of this type, which are implemented with waveguide, coax, or stripline technologies, generally obtain high directivity rather easily because of the media being used. However, a directional coupler implemented with microstrip technology has rather undesirable properties. An example of a conventional microstrip directional coupler is shown in the illustrative embodiment of FIG. 1.

Referring to FIG. 1, a dielectric layer 10 is disposed over the surface of a ground plane 12. On the exposed surface 14 of the dielectric layer 10, there may be disposed a main microstrip transmission line 16 and a coupled microstrip transmission line 18. The two transmission lines 16 and 18 may have a coupling region approximately outlined by the dashed line 20. The coupling coefficient therebetween is generally dependent on the coupling region 20, more particularly, the gap 22 between the transmission lines 16 and 18 and the length 24 of the region 20. The length of the coupling region is generally on the order of one-quarter wavelength of the microwave signal being sampled by the directional coupler.

Because of the electromagnetic properties of the microwave signal conducted over the main transmission line 16, signal components are both capacitively and inductively coupled into the transmission line 18 primarily in the coupling region denoted by 20. In a typical sampling type microwave coupler, the power signal measured at one port of the coupled transmission line 18, like port 26, for example, is generally much smaller than, but representative of, the microwave signal incident to terminal 32 and conducted over the main transmission line 16. Moreover, a power signal measured at the other port of the coupled transmission line 18, like port 28, for example, is representative of the reflected or unwanted microwave signals conducted over the transmission line 16 in the reverse direction to the primary or incident microwave signal flow. A significant power signal measurement at port 28 when the terminal 34 is perfectly terminated is an indication of poor directivity of the microwave coupler.

For the most part, loosely coupled or edge coupled microstrip directional couplers of the type just described generally have directivity which decreases with increasing frequency of the microwave signal conducted over the main line. High directivity, in these cases, becomes even more difficult to obtain as the coupling is loosened. This problem occurs primarily because the propagating velocities of the even and odd modes of the microwave signals conducted over the transmission lines 16 and 18 are not equal.

Various techniques have been used to increase the directivity of the microwave couplers implemented with microstrip technology. For example in one case, capacitive tabs were attached at the ends of the coupling region. However, this technique generally tended to decrease the overall coupler frequency bandwidth. Another technique included the use of overlaying the main and coupled transmission lines in the coupling region with a layer of dielectric therebetween. While this technique provides equal even and odd mode velocities and may be used in broadband applications, there are attendant fabricational problems that frequently make its use undesirable.

Still another technique for increasing the directivity of microstrip microwave couplers is that of wiggling the adjacent edges of the main and coupled transmission lines in the coupling region. The resulting apparatus is commonly referred to as a "wiggly line" microwave coupler. In this technique, the wiggly transmission lines under certain conditions slow the odd mode waves without substantially affecting the even mode waves. However, in a loosely coupled microstrip coupler (say 20 db or greater) with a high dielectric medium such as alumina, for example, and a gap greater than the line width, the wiggling of the transmission lines may effect both even and odd mode waves. Consequently, for this case, any attempt to adequately slow down the odd mode wave by further increasing the severity of the wiggling of the transmission lines is expected to have a similar effect on the even mode wave and thus, be ineffective for the purposes of increasing directivity.

In view of the above remarks, it is quite evident that, to achieve high directivity in a loosely coupled microwave coupler of the microstrip version, something must be done to avoid or alleviate the problems associated with directivity effects arising from the different velocities of the even and odd mode waves between the microwave signals conducted over the main and coupled transmission lines. It is the purpose then of the present invention to resolve this problem area and describe a microstrip embodiment of a loosely coupled microwave coupler with high directivity.

SUMMARY OF THE INVENTION

A microwave signal coupler for coupling a microwave signal loosely from a main microstrip transmission line to a coupled microstrip transmission line with high directivity includes a ground plane, a dielectric substrate layer disposed over the ground plane, and a section of each of the main and coupled microstrip transmission lines disposed on the exposed surface of the dielectric substrate layer adjacently aligned with a predetermined gap therebetween to form a coupling region. In accordance with the present invention, the length of the coupling region is substantially less than $\frac{1}{4}$ wavelength of the microwave signal. In addition, a capacitive coupling element is disposed within the coupling region across the main and coupled transmission line sections for supplementing the dielectric capacitive coupling of the gap therebetween to increase the directivity of the microwave signal coupling.

More specifically, the capacitive coupling element splits the coupled transmission line section of the coupling region into two branches, and is physically adjustable in size to balance the electric and magnetic field microwave signal coupling components of one of the branches and reduce the microwave power output thereof, whereby the microwave power output of the other of the branches is representative of the microwave signal incident on the main transmission line section substantially.

In one embodiment the coupled transmission line section includes a microstrip tab extending transversely therefrom in the gap and positioned away from either end of the coupling region. The tab extension reduces the gap between the main and coupled transmission line sections in the region thereof to provide a supplemental capacitive coupling between the transmission line sections. The microstrip tab is physically alterable in size for adjusting the capacitive coupling. In another embodiment the main and coupled transmission line sections include a plurality of spaced-apart microstrip tabs extending transversely therefrom in the gap to form a pattern of interleaved fingers positioned away from either end of the coupling region. This pattern of interleaved fingers provides a supplemental capacitive coupling between the transmission line sections, the tabs being physically alterable in size for adjusting the capacitive coupling. In either embodiment, at least one of the microstrip transmission line sections has a V-shaped notch removed from the width thereof in an area approximately opposite the microstrip tab extension(s) to compensate for the line to ground capacitance of the tabs.

DESCRIPTION OF THE PREFERRED EMBODIMENT

Figure 1:
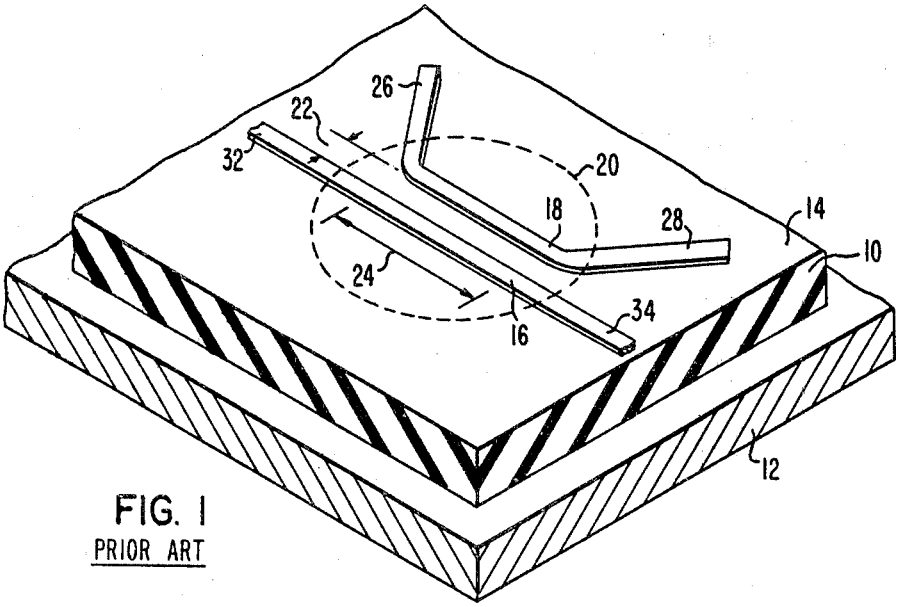
FIG. 1 PRIOR ART
FIG. 1 is an isometric view of a typical microstrip embodiment of a microwave coupler.

Referring to FIG. 1, to avoid or alleviate the problems resulting from the different velocities of the even and odd mode waves occurring between the transmission lines 16 and 18, the length 24 of the coupling region 20 may be made small relative to a wavelength of the operating microwave signal, preferably on the order of 1/10 of a wavelength or less. Because the coupling region 20 is significantly reduced from the traditional one-quarter wavelength size, the capacitive coupling component of the electromagnetic microwave signal conducted over the coupled transmission line section will be inadequately small and consequently should be increased for effective directional performance of the coupler.

In accordance with the present invention, a supplemental capacitive coupling element is disposed within the coupling region 20 and coupled across the main and coupled transmission line sections 16 and 18 for supplementing the capacitive coupling therebetween to increase the directivity of the microwave signal coupling. The new embodiment with the added capacitive coupling element may be described in accordance with an illustrative planar view of the microstrip circuitry as depicted in FIG. 2.

Figure 2:
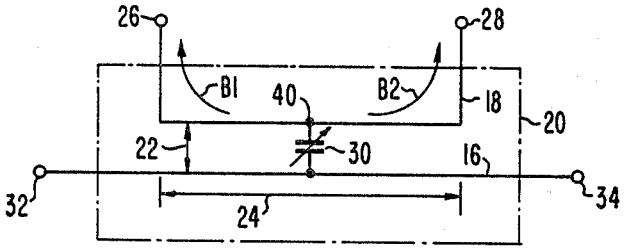
FIG. 2 illustrates a plan view of a microstrip microwave coupler embodying the principles of the present invention.

Referring to FIG. 2, the coupling region 20 may be comprised of a section of each of the main and coupled microstrip transmission lines 16 and 18, respectively, disposed on the exposed surface of the dielectric layer (see FIG. 1) adjacently aligned with a predetermined gap 22 therebetween. The length 24 of the coupling region in this embodiment is substantially less than one-quarter wavelength of the operating microwave signal. The capacitive coupling element 30 is shown as a lumped element 30 coupled between the main and coupled transmission line sections 16 and 18 in the gap 22. In this embodiment, the main transmission line section 16 of the coupling region 20 includes an input terminal 32 and an output terminal 34 and with a like arrangement, the coupled transmission line section 18 may have two similar terminals 26 and 28. The capacitive coupling element 30 splits the coupled transmission line section 18 into two branches B1 and B2. Moreover, the capacitive coupling element 30 may be physically adjustable in size to reduce the net microwave signal coupling to one of the branches, say B2 for example, while enhancing the net microwave signal coupling to the other of the branches B1, for example.

In operation, the coupler depends upon the electromagnetic properties of a microwave signal as it is propagated on the main line section 16 between terminals 32 and 34. Both the electric and magnetic field components of the microwave signal effect current components in the coupled transmission line section connected across terminals 26 and 28. The capacitive element 30, which is preferably centrally located within the gap 22 away from the ends of the coupling region 20, defines a point of reference 40 on the coupled transmission line section 18. The branches B1 and B2 may then be defined as being to the left and right, respectively, of the reference point 40.

Figure 3:
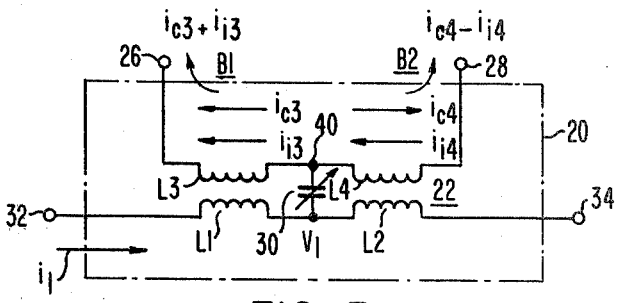
FIG. 3 is a lumped parameter schematic suitable for functionally describing the principles of applicants' invention.

A functional model of the operation of the coupling region 20 is depicted in FIG. 3. In the main transmission line 16, the microstrip to the left and right of the capacitive element 30 may be modeled as lumped inductive elements L1 and L2, respectively, and similarly, the microstrip of the coupled transmission line section to the left and right of the reference point 40 may be modeled as lumped inductive elements L3 and L4, respectively. The inductive elements L1–L3 and L2–L4 are operative to magnetically couple the components denoted as $i_{i3}$ and $i_{i4}$ to the transmission line 18 and similarly, the capacitance in the gap between the transmission lines is operative to electrostatically generate the components denoted as $i_{c3}$ and $i_{c4}$ in their respective branches B1 and B2. As shown by the schematic diagram model of FIG. 3, the coupled current components in branch B1 are in-phase and conversely, in the other branch B2, the coupled current components are substantially 180° out-of-phase. Accordingly, if the current components produced from the electric and magnetic field couplings are of equal magnitude in branch B2, no net power will be developed in the branch as a result.

The reason that the coupled components of the branch line currents are in phase in branch B1 and 180° out-of-phase in branch B2 may be explained by the following rational. The capacitive element 30, which supplements the dielectric capacitance of the gap 22, constitutes a capacitive voltage divider in terms of the electric field coupling between the main line 16 and coupled line 18. As a result, a microwave signal of voltage V1 conducted over the main transmission line 16, is electrostatically coupled through the capacitive element 30 to the reference point 40 to effect currents in the coupled line 16 which flow in parallel through branches B1 and B2. In addition, the microwave current $i_1$ conducted over the main transmission line section 16 may, by utilizing the inductive element pairs L1–L3 and L2–L4, magnetically couple current components which flow in series through branches B2 and B1.

For the case of the present embodiment, note that if the capacitive coupling element 30 is adjusted in size to substantially equalize the magnitudes of a pair of currents coupled components in branch B2, for example, the net current thereof may be reduced, preferably to zero, with no power being developed at terminal 28. Physically, zero current in branch B2 may not be fully achieved because the field intensities are generally never exactly uniform along the length 24 of the microstrip coupling region 20. As a result, the current components of the branch B2 may not be exactly 180° out-of-phase to entirely cancel each other. However, if the length 24 of the coupling region 20 is made small compared with the operating wavelength of the microwave signal, as is the case in the present embodiment, a very good approximation to zero current and thus high directivity is obtained. It is understood that the absolute values of the magnitudes of the current components of the branches B1 and B2 may be adjusted by changing the length 24 or the gap 22 of the coupling region 20. Correspondingly, the capacitive coupling element 30 may be independently adjusted for increasing the directivity of the coupling region 20.

Generally, the forward coupling factor and reverse coupling factor of a microwave coupler closely follows a 6 dB per octave increase with frequency. For example, a component of the magnetic flux effected by the current $i_1$ (see FIG. 3) couples to the adjacent branch lines B1 and B2 and induces the currents $i_{i3}$ and $i_{i4}$ therein proportional to the time rate of change of the coupling magnetic flux. Thus, the currents $i_{i3}$ and $i_{i4}$ are proportional to frequency and the 6 dB per octave rule applies. Similarly, a microwave voltage $V_1$ on the main line 16 electrostatically generates currents $i_{c3}$ and $i_{c4}$ in branches B1 and B2, respectively, which have a magnitude primarily dependent on the reactance of the adjustable capacitive element 40. Consequently, the current components $i_{c3}$ and $i_{c4}$ are also proportional to the frequency of the microwave signal and therefore the 6 dB per octave rule again applies. Accordingly, by adjusting the value of the capacitive element C, the current component $i_{c4}$ may be made approximately equal to the current component $i_{i4}$ to achieve cancellation of the currents in branch B2 essentially independent of frequency.

Because the net currents in the branches B1 and B2 are, for the most part, proportional to the frequency of the operating microwave signal, the net current in the branch B1, which may be referred to as the direct coupled arm, has a predictable frequency variation which may be formulated as $(\omega/\omega_0)^2$ as does the net coupled current in the branch B2, which may be referred to as the isolated arm. It follows then that if the capacitive coupling element 30 is adjusted to obtain good isolation at one frequency, then the isolation is maintained over a wide band of frequencies. In fact, with the isolation being measured as a ratio of the sum and difference terms of the net coupled currents of the branches B1 and B2, then the isolation is essentially independent of frequency.

Figure 4:
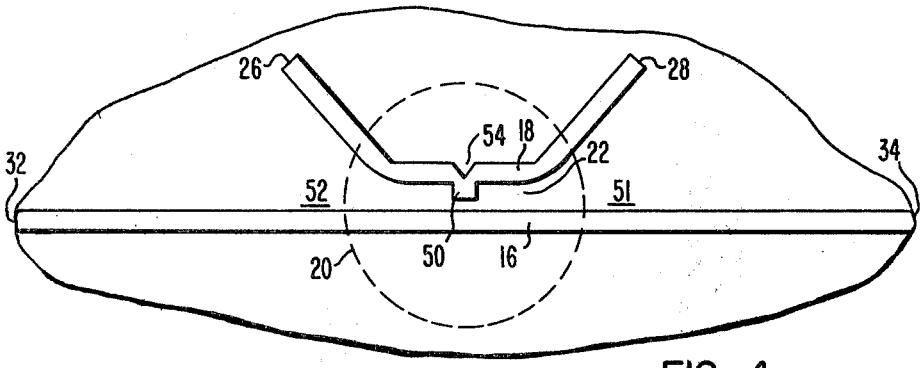
FIG. 4 depicts a plan view of a microstrip microwave coupler embodying the principles of applicants' invention.

Referring to FIG. 4, as one embodiment of the present invention, the coupled transmission line section 18 may include a microstrip tab 50 extending transversely therefrom in the gap 22 and positioned away from either of the ends 51 and 52 of the coupling region 20. The microstrip tab extension 50 reduces the gap 22 between the main and coupled and transmission line sections 16 and 18, respectively, in the region thereof to provide a supplemental capacitive coupling between the transmission line sections. In addition, the microstrip tab 50 may be physically altered in size by cutting away sections, for example, for adjusting the capacitive coupling thereof. In this same embodiment, a V-shaped notch 54 may be removed from the width of the coupled transmission line section 16 in an area approximately opposite that of the microstrip tab extension 50 to provide continuity of coupled signal flow in the transmission line 16. Typical parameter values of this embodiment may be as follows:

length=0.212 inches
microstrip width=0.020 inches
gap=0.035 inches
relative dielectric constant=9.0
dielectric material thickness=0.020 inches
capacitance=0.075 pf.

Figure 5:
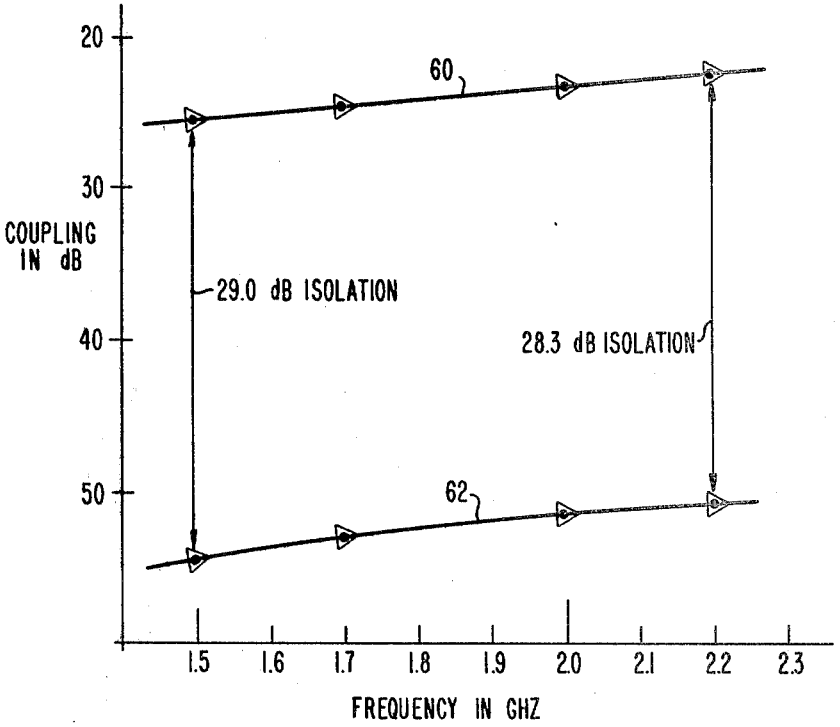
FIG. 5 is a graph depicting the results of an analysis of one embodiment of the present invention.

The model of the microstrip coupler embodiment described in connection with FIG. 4 in accordance with the above coupler parameters was analyzed and typical results of the analysis are presented in FIG. 5 for both the forward and reverse conditions.

The top line 60 of the graph represents a set of computed power levels $P_m$ at terminal 26 over the range of approximately 1.5 to 2.3 Gigahertz. In a similar manner, the line 62 represents a group of frequency related power level $P_m$ calculated to appear at the terminal 28. Terminals 26 and 28 are commonly referred to as the direct branch and isolated branch terminals, respectively. All points on the graph of FIG. 5 were computed in dB's (10 log $P_m/P_O$) assuming the conditions of a fixed microwave power signal $P_O$ at the input 32, and reflect the coupling coefficient of the coupling region 20. The 6 dB per octave frequency variation of the coupling coefficient is nicely demonstrated by the graph of FIG. 5 as is also the consistency of the isolation over the broad microwave frequency range under which the tests were conducted. The slight difference in isolation (0.7 dB) across the microwave bandwidth used is considered primarily the effect of mode velocity differences.

In addition, actual power measurements of a coupler similar to the one of FIG. 4 were taken at the terminals 26 and 28 under the conditions of a fixed microwave power signal $P_O$ supplied at the input 32 of the main transmission line 16 with a fixed termination impedance at the output 34 thereof. An example of these measurements have been presented in Table 1 herebelow for various microwave frequencies.

TABLE 1

| FREQ (MHz) | INPUT REFLECTION MAGNITUDE | INPUT REFLECTION ANGLE (DEGREES) | INPUT VSWR | COUPLED PORT GAIN (dB) | COUPLED PORT PHASE (DEGREES) |
|---|---|---|---|---|---|
| Forward: | | | | | |
| 700.000 | .040 | −60.2 | 1.082 | −25.44 | −82.3 |
| 725.000 | .041 | −75.5 | 1.086 | −25.20 | −88.5 |
| 750.000 | .042 | −91.7 | 1.089 | −24.92 | −93.4 |
| 775.000 | .044 | −106.8 | 1.092 | −24.76 | −99.9 |
| 800.000 | .046 | −120.1 | 1.097 | −24.45 | −106.5 |
| 825.000 | .048 | −131.8 | 1.100 | −24.10 | −112.3 |
| 850.000 | .049 | −144.8 | 1.104 | −23.93 | −118.0 |
| 875.000 | .051 | −156.6 | 1.108 | −23.81 | −123.8 |
| 900.000 | .052 | −166.0 | 1.110 | −23.52 | −130.9 |
| 925.000 | .052 | −177.6 | 1.111 | −23.22 | −136.8 |
| 950.000 | .053 | 172.2 | 1.113 | −23.07 | −142.1 |
| 975.000 | .052 | 164.7 | 1.110 | −22.89 | −147.9 |
| 1000.000 | .051 | 154.7 | 1.107 | −22.75 | −154.7 |
| 1025.000 | .049 | 144.9 | 1.104 | −22.52 | −161.4 |
| 1050.000 | .048 | 138.6 | 1.100 | −22.30 | −166.5 |
| 1075.000 | .045 | 131.1 | 1.094 | −22.17 | −171.9 |
| 1100.000 | .042 | 123.0 | 1.088 | −22.03 | −178.7 |
| 1125.000 | .040 | 116.7 | 1.083 | −21.84 | 174.5 |
| 1150.000 | .036 | 111.7 | 1.076 | −21.56 | 169.0 |
| 1175.000 | .033 | 106.2 | 1.067 | −21.49 | 163.4 |
| 1200.000 | .030 | 102.7 | 1.062 | −21.40 | 157.3 |
| Reverse: | | | | | |
| 700.000 | .040 | −60.2 | 1.082 | −44.44 | −155.6 |
| 725.000 | .041 | −75.6 | 1.086 | −44.71 | −162.8 |
| 750.000 | .042 | −91.5 | 1.088 | −44.37 | −170.0 |
| 775.000 | .044 | −106.5 | 1.092 | −44.36 | −179.2 |
| 800.000 | .046 | −119.8 | 1.098 | −44.34 | 172.3 |
| 825.000 | .047 | −132.2 | 1.099 | −44.30 | 165.3 |
| 850.000 | .049 | −144.3 | 1.104 | −44.29 | 158.0 |
| 875.000 | .051 | −156.4 | 1.108 | −44.43 | 149.3 |
| 900.000 | .052 | −166.1 | 1.109 | −44.41 | 140.3 |
| 925.000 | .052 | −177.4 | 1.111 | −44.59 | 134.2 |
| 950.000 | .053 | 172.4 | 1.113 | −44.48 | 128.0 |
| 975.000 | .052 | 164.5 | 1.110 | −44.71 | 120.5 |
| 1000.000 | .050 | 154.5 | 1.106 | −44.87 | 110.4 |
| 1025.000 | .049 | 145.1 | 1.104 | −44.87 | 104.2 |
| 1050.000 | .048 | 138.8 | 1.100 | −44.90 | 98.3 |
| 1075.000 | .045 | 131.2 | 1.093 | −45.11 | 90.4 |
| 1100.000 | .042 | 123.2 | 1.088 | −45.51 | 84.4 |
| 1125.000 | .040 | 116.7 | 1.083 | −45.36 | 78.9 |
| 1150.000 | .036 | 112.2 | 1.075 | −45.24 | 72.8 |
| 1175.000 | .033 | 106.9 | 1.068 | −45.60 | 65.3 |
| 1200.000 | .030 | 102.1 | 1.062 | −45.79 | 61.7 |

Figure 6:
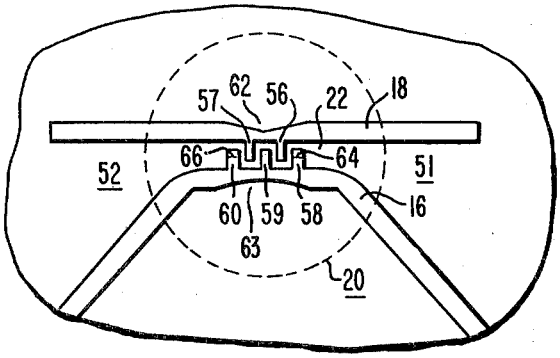
FIG. 6 is a plan view of another embodiment of a microstrip microwave coupler also suitable for embodying the principles of applicants' invention.

Another embodiment for the capacitive coupled element 30 is shown in the plan view of the main and coupled microstrip transmission line sections of FIG. 6. In this embodiment, each of the main and coupled transmission line sections 16 and 18, respectively, include a plurality of spaced apart microstrip tabs extending transversely therefrom in the gap 22 to form a pattern of interleaved fingers positioned away from the ends 51 and 52 of the coupling region 20. This pattern of interleaved fingers provides a supplemental capacitive coupling between the transmission line sections 16 and 18.

For example, the coupled transmission line section 18 may include two spaced apart microstrip tabs 56 and 57 and the main transmission line section 16 may include three spaced apart microstrip tabs 58, 59 and 60 interleaved with the coupled line section tabs within the gap 22 of the coupling region 20. Moreover, the main and coupled transmission line microwave sections 16 and 18 may have V-shaped notches 62 and 63 removed from the width thereof at an area approximately opposite the plurality of microstrip tab extensions to provide microwave signal flow continuity across the capacitive coupling region. Accordingly, the interleaved microstrip tabs may be physically altered in size, such as cutting a portion of them away (see dashed lines 64 and 66), for example, for adjusting the capacitive coupling thereof.

A model of the embodiment as described in connection with FIG. 6 was analyzed in a similar manner as that of the embodiment of FIG. 5 described supra. In a typical analysis, the coupler model included microstrip tab widths of 0.01 inches, microstrip tab spacings of 0.01 inches and microstrip tab lengths on the order of 0.018 inches. Exemplary results of the analysis using the aforementioned parameter values are shown in Table 2 herebelow.

While applicants' invention has been described in connection with the embodiments of FIGS. 4 and 6 hereabove, it is understood by anyone skilled in the pertinent art that other embodiments may also suitably facilitate the broad principles of applicants' invention as depicted in the functional representation of FIG. 3. Therefore, the present invention should not be limited to any one embodiment, but rather construed in connection with the recitation of the appended claims following this specification.

TABLE 2

| FREQ (MHz) | FORWARD VSWR | FORWARD GAIN (dB) | REVERSE VSWR | REVERSE GAIN (dB) |
|---|---|---|---|---|
| 1200.000 | 1.038 | −25.75 | 1.038 | −49.36 |
| 1225.000 | 1.040 | −25.60 | 1.040 | −49.69 |
| 1250.000 | 1.048 | −25.38 | 1.048 | −48.50 |
| 1275.000 | 1.049 | −25.32 | 1.050 | −48.17 |
| 1300.000 | 1.050 | −25.16 | 1.051 | −48.18 |
| 1325.000 | 1.054 | −25.15 | 1.054 | −47.97 |
| 1350.000 | 1.057 | −24.91 | 1.059 | −47.86 |
| 1375.000 | 1.056 | −24.92 | 1.057 | −47.43 |
| 1400.000 | 1.060 | −24.68 | 1.060 | −47.04 |
| 1425.000 | 1.066 | −24.47 | 1.066 | −47.46 |
| 1450.000 | 1.067 | −24.55 | 1.067 | −47.21 |
| 1475.000 | 1.066 | −24.36 | 1.066 | −46.78 |
| 1500.000 | 1.068 | −24.31 | 1.069 | −46.34 |
| 1525.000 | 1.072 | −24.13 | 1.072 | −46.23 |
| 1550.000 | 1.073 | −24.03 | 1.073 | −46.53 |
| 1575.000 | 1.073 | −23.88 | 1.073 | −45.89 |
| 1600.000 | 1.075 | −23.88 | 1.076 | −45.74 |
| 1625.000 | 1.077 | −23.74 | 1.077 | −45.46 |
| 1650.000 | 1.074 | −23.71 | 1.073 | −45.71 |
| 1675.000 | 1.076 | −23.55 | 1.076 | −45.53 |
| 1700.000 | 1.079 | −23.45 | 1.079 | −45.13 |
| 1725.000 | 1.076 | −23.42 | 1.075 | −45.26 |
| 1750.000 | 1.073 | −23.34 | 1.073 | −45.43 |
| 1775.000 | 1.076 | −23.28 | 1.076 | −45.37 |
| 1800.000 | 1.075 | −23.07 | 1.075 | −44.71 |
| 1825.000 | 1.070 | −23.01 | 1.069 | −44.66 |
| 1850.000 | 1.070 | −23.01 | 1.069 | −45.00 |
| 1875.000 | 1.070 | −22.98 | 1.069 | −44.93 |
| 1900.000 | 1.066 | −22.84 | 1.066 | −44.68 |
| 1925.000 | 1.061 | −22.81 | 1.060 | −44.54 |
| 1950.000 | 1.062 | −22.61 | 1.060 | −44.55 |
| 1975.000 | 1.058 | −22.73 | 1.057 | −44.78 |
| 2000.000 | 1.053 | −22.51 | 1.052 | −44.27 |
| 2025.000 | 1.049 | −22.85 | 1.048 | −43.79 |
| 2050.000 | 1.048 | −22.29 | 1.047 | −43.81 |
| 2075.000 | 1.043 | −22.35 | 1.043 | −43.88 |
| 2100.000 | 1.039 | −22.19 | 1.038 | −43.75 |
| 2125.000 | 1.034 | −22.18 | 1.033 | −43.41 |
| 2150.000 | 1.032 | −22.12 | 1.032 | −43.31 |
| 2175.000 | 1.029 | −22.05 | 1.029 | −43.20 |
| 2200.000 | 1.025 | −22.06 | 1.024 | −43.32 |
| 2225.000 | 1.023 | −21.90 | 1.023 | −42.84 |
| 2250.000 | 1.025 | −21.91 | 1.024 | −42.79 |
| 2275.000 | 1.028 | −21.85 | 1.028 | −42.86 |
| 2300.000 | 1.030 | −21.82 | 1.030 | −42.97 |
| 2325.000 | 1.035 | −21.75 | 1.035 | −42.50 |
| 2350.000 | 1.041 | −21.68 | 1.041 | −42.30 |
| 2375.000 | 1.048 | −21.65 | 1.048 | −42.27 |
| 2400.000 | 1.054 | −21.70 | 1.055 | −42.19 |
| 2425.000 | 1.063 | −21.61 | 1.063 | −41.93 |

What we claim is:

1. A microwave signal coupler for coupling a microwave signal loosely from a main microstrip transmission line to a coupled microstrip transmission line with high directivity, said coupling including:

a ground plane;

a dielectric substrate layer disposed over said ground plane;

a section of each of said main and coupled microstrip transmission lines disposed on the exposed surface of said dielectric substrate layer adjacently aligned with a predetermined gap therebetween to form a coupling region, the length of said coupling region being substantially less than one-quarter wavelength of said microwave signal;

a capacitive coupling element disposed within said coupling region across said main and coupled transmission line sections for supplementing the dielectric capacitive coupling of the gap therebetween to increase the directivity of said microwave signal coupling, said capacitive coupling element splitting the coupled transmission line section of the coupling region into two branches, said capacitive coupling element being physically adjustable in size to balance the electric and magnetic field microwave signal coupling components of one of said branches and to reduce the microwave power output thereof; and at least one of the microstrip transmission line coupling sections having a V-shaped notch removed from the width thereof on a side opposite said gap and in the proximity of said capacitive coupling element.

2. A microwave signal coupler in accordance with claim 1 wherein the capacitive coupling element includes a microstrip tab extending transversely from the coupled transmission line section in the gap and positioned away from either end of the coupling region, said microstrip tab extension reducing the gap between the main and coupled transmission line sections in the region thereof to provide a supplemental capacitive coupling between the transmission line sections, said microstrip tab being physically alterable in size for adjusting said capacitive coupling.

3. A microwave signal coupler in accordance with claim 2 wherein the coupled microstrip transmission line section has a V-shaped notch removed from the width thereof in an area approximately opposite the microstrip tab extension.

4. A microwave signal coupler in accordance with claim 1 wherein the capacitive coupling element includes a plurality of spaced apart microstrip tas extending transversely from each of the main and coupled transmission line sections in the gap to form a pattern of interleaved fingers positioned away from either end of the coupling region, said pattern of interleaved fingers providing a supplemental capacitive coupling between said transmission line sections, said interleaved microstrip tabs being physically alterable in size for adjusting said capacitive coupling.

5. A microwave signal coupler in accordance with claim 4 wherein the coupled transmission line section includes two spaced apart microstrip tabs and the main transmission line section includes three spaced apart microstrip tabs interleaved with said coupled line section tabs within the gap of the coupling region.

6. The microwave signal coupler in accordance with claim 4 wherein both of the main and coupled transmission line sections have V-shaped notches removed from the widths thereof in an area approximately opposite the plurality of microstrip tab extensions.

* * * * *